United States Patent [19]

Yasuda et al.

[11] Patent Number: 4,979,885

[45] Date of Patent: Dec. 25, 1990

[54] COMPRESSOR WITH SEALING MEANS FOR INTERNAL GAS AND LUBRICANT AND HAVING CAPABILITY OF LOWERING INTERNAL GAS PRESSURE

[75] Inventors: Masao Yasuda; Hideo Kure, both of Kanagawa, Japan

[73] Assignee: Atsugi Motor Parts Company, Limited, Kanagawa, Japan

[21] Appl. No.: 332,470

[22] Filed: Apr. 3, 1989

[30] Foreign Application Priority Data

Apr. 4, 1988 [JP] Japan ..... 63-45821[U]

[51] Int. Cl.[5] ..... F04C 29/10

[52] U.S. Cl. ..... 418/270; 137/800

[58] Field of Search ..... 418/270; 417/454, 572; 137/800; 220/366, 367

[56] References Cited

U.S. PATENT DOCUMENTS 4,510,659 4/1985 Okazaki ..... 418/270

*Primary Examiner*—John J. Vrablik

*Assistant Examiner*—David L. Cavanaugh

*Attorney, Agent, or Firm*—Bachman & LaPointe

[57] ABSTRACT

A sealing plug has a stem portion inserted into an inlet of the compressor and contacted with a valve body of a check valve for forcing the check valve from closed position to maintain the check valve at open position. The sealing plug is also provided with a seal body for establishing a fluid tight seal at the sealing position. The seal body can be shifted from the sealing position to gas discharge position with maintaining the stem portion contacting the valve body of the check valve to keep the latter open. At the gas discharge position, the sealing plug permits the pressurized gas in the compressor to be discharged for lowering the internal gas pressure.

9 Claims, 2 Drawing Sheets

COMPRESSOR WITH SEALING MEANS FOR INTERNAL GAS AND LUBRICANT AND HAVING CAPABILITY OF LOWERING INTERNAL GAS PRESSURE

BACKGROUND OF THE INVENTION

1. Field of the Invention

The present invention relates generally to a compressor, such as a compressor for an automotive air conditioner system. More particularly, the invention relates to a compressor with means for sealing gas and lubricant.

2. Description of the Background Art

In general, a compressor is filled with a predetermined amount of lubricant for lubrication of rotating and/or thrusting components. The amount of lubricant has to be enough for successfully establishing a lubricating layer between rotating or thrusting component and stationary components even at high load conditions on the compressor. It is also a typical manner of shipping the compressor to fill the compressor with an inert gas, such as a nitrogen gas, for anti-rusting purposes. In order to hold the inert gas and lubricant during transportation, sealing plugs are engaged with the inlet and outlet of the compressor, which inlet and outlet are to be connected a to fluid circuit when it is assembled an to associated unit, such as an automotive air conditioner system.

A typical construction has been disclosed in Japanese Patent First (unexamined) Publication No. 62-135680. In the shown construction, the compressor housing is formed with an inlet and an outlet so that the compressor can be connected to the associated unit, such as the air conditioner system, for introducing low pressure fluid and feeding pressurized fluid for circulating in a fluid circuit. A check valve is provided in the vicinity of the inlet for preventing surge flow of the high pressure fluid. The check valve is maintained at open position while the compressor is driven so that the fluid can be introduced through the inlet. While the compressor in the inoperative state, the check valve is subject to internal pressure of the compressor to be maintained at the closed position.

Upon shipping the individual assembly of the compressor disconnected from the associated unit, the inlet and the outlet are sealed by means of sealing plugs engaged thereto. The compressor is filled with a predetermined amount of lubricant and an inert gas which is filled for anti-rusting purposes. The lubricant is typically filled in the discharge chamber which is provided in fluid communication with the outlet. For completing the anti-rusting purpose the inert gas has to be filled completely by replacing it with an oxygen containing gas, such as an air. Therefore, relatively high pressure of inert gas is required to assure removal of oxygen containing gas.

Upon assembling the compressor with the associated unit by connecting the inlet and outlet to the associated fluid circuit, the sealing plugs must be removed. When the sealing plug engaged with the outlet is removed or unsealed, the pressurized lubricant can be discharged due to internal pressure. It may be desirable to remove the inert gas pressure through the inlet which is not directly connected to the discharge chamber. However, removal of the sealing plug engaged in the inlet does not allow the inert gas to be discharged because of presence of the check valve. Namely, because of high internal pressure, the check valve is held in the closed position so as not to permit the pressurized inert gas from being discharged through the inlet.

SUMMARY OF THE INVENTION

Therefore, it is an object of the present invention to provide a sealing structure for sealing an inlet and an outlet of a compressor which can permit lowering internal gas pressure without causing discharge of lubricant.

Another object of the invention is to provide a seal plug which is useful to applying for a compressor for establishing a fluid tight seal during shipping and which is effective for removing inert gas pressure through an inlet of the compressor.

In order to accomplish the aforementioned and other objects, a sealing plug according to the present invention has a stem portion inserted into an inlet of the compressor and contacted with a valve body of a check valve for forcing the check valve from the closed position to maintain the check valve at the open position. The sealing plug is also provided with a seal body for establishing a fluid tight seal at the sealing position. The seal body can be shifted from the sealing position to the gas discharge position with maintaining the stem portion contacting with the valve body of the check valve to keep the latter open. At the gas discharge position, the sealing plug permits the pressurized gas in the compressor to be discharged for lowering the internal gas pressure.

According to one aspect of the invention, in a structure for enclosing a liquid state fluid and a pressurized gaseous state fluid, the structure has an opening exposed to outside of the structure for external connection, a check valve provided in the vicinity of the opening to permit fluid flow from the outside of the structure to the inside of the structure and to block fluid flow in the opposite direction, and a chamber receiving the liquid state fluid therein, which chamber is blocked from direct communication with the opening, the improvement of the present invention comprises, a sealing structure which comprises:

a sealing plug pluged into the opening for establishing a fluid tight seal, the first plug having means associated with the check valve for operating the check valve at an open position for permitting fluid flow from the inside of the structure to the outside of the structure, the sealing plug being movable between a first sealing position for establishing gas tight seal and a second gas discharging position to permit the pressurized gaseous fluid to flow from the inside to outside.

According to another aspect of the invention, in a structure for enclosing a liquid state fluid and a pressurized gaseous state fluid, the structure having first and second openings exposed to outside of the structure for external connection, a check valve provided in the vicinity of the first opening to permit fluid flow from the outside of the structure to the inside of the structure and to block fluid flow in the opposite direction, and a chamber receiving the liquid state fluid therein, which chamber is oriented in direct communication with the second opening and blocked direct communication with the first opening, the improvement of the present invention comprises a sealing structure which comprises:

a first sealing plug pluged into the first opening for establishing a fluid tight seal, the first plug having means associated with the check valve for operating the check valve at an open position for permitting fluid flow from the inside of the structure to the outside of the structure, the first plug being movable between a first sealing position for establishing gas tight seal and a second gas discharging position to permit the pressurized gaseous fluid to flow from the inside to outside; and a second sealing plug sealingly pluged into the second opening for establishing fluid tight seal.

According to a further aspect of the invention, in a compressor having an enclosed space filled with a lubricant for lubricating components housed within the space, and a pressurized gas, the compressor defining an inlet opening and an outlet opening for connection with an external fluid circuit, and a chamber in direct communication with the outlet opening, the chamber receiving the lubricant, a sealing structure temporarily sealing the inlet opening and outlet opening, the present invention comprises:

a first sealing plug pluged into the inlet opening for establishing a fluid tight seal, the first plug having means associated with the check valve for operating the check valve at an open position for permitting fluid flow from the inside of the structure to the outside of the structure, the first plug being movable between a first sealing position for establishing gas tight seal and a second gas discharging position to permit the pressurized gaseous fluid to flow from the inside to outside; and a second sealing plug sealingly pluged into the outlet opening for establishing a fluid tight seal.

Preferably, the first and second sealing plugs are made of elastic material. The check valve comprises a valve body associated with a valve seat for establishing fluid tight seal when it is seated on the valve seat and for permitting fluid flow when it is placed away from the valve seat, and the check valve operating means comprises a projection projecting from the main body of the plug to depress the valve body to maintain the latter away from the valve seat.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
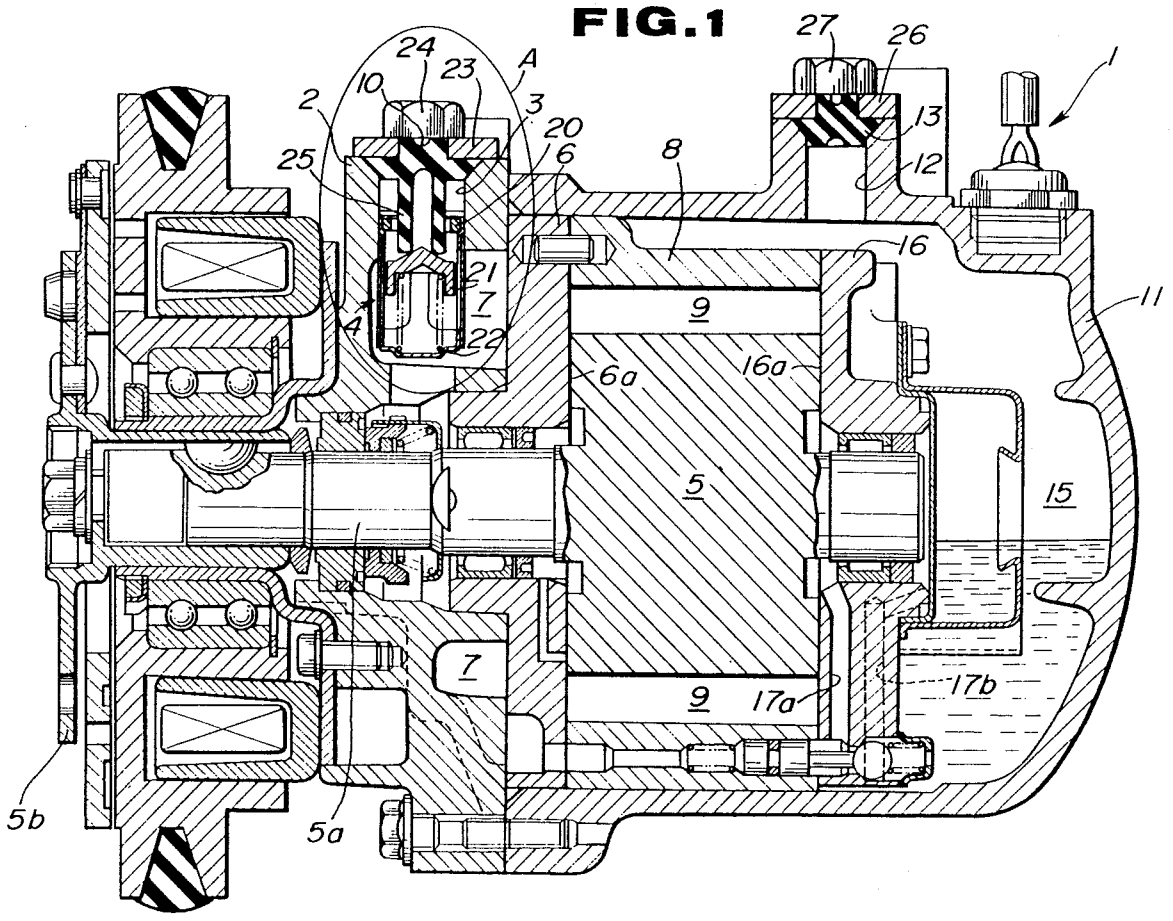
FIG. 1 is a section of a compressor, with which embodiment a sealing plug according to the present invention is applied for sealing an inlet and outlet.

Referring now to the drawings, particularly to FIG. 1, the preferred embodiment of a sealing structure for a compressor will be discussed herebelow in terms of an application for a vane-type rotary compressor which is suitable for use in an automotive air conditioner system, for example. The vane-type rotary compressor has a compressor housing 1. The front end of the compressor housing 1 is closed by a head cover 2. An inlet opening 3 is formed through the head cover 2. The inlet opening 3 is adapted to be connected to an external circuit, such as an air conditioner refrigerant circulation circuit in order to introduce a fluid to be compressed. A check valve 4 is provided in the vicinity of the inlet opening 3 for preventing the internal pressurized fluid from causing surge flow.

The compressor housing 1 houses therein a cam ring 8 and a rotor 5 which carries a plurality of rotor vanes for defining variable volume pressure chambers 9 and is associated with a drive unit, such as an automotive engine to be rotatingly drive by the driving torque transmitted through a drive shaft 5*a* via a power train including a driving driven pulley 5*b*. The axial front end of the cam ring 8 is closed by a front plate 6 and the axial rear end of the cam ring is closed by a rear plate 16. The inlet opening 3 is in communication with the pressure chambers 9 through a per se known fluid path including a induction chamber 7.

The rear axial end of the compressor housing 1 is closed by a rear cover 11. The rear cover 11 defines an outlet opening 12 which is connected to the external fluid circuit for feeding the pressurized fluid therethrough. The rear cover 11 is cooperative with the rear plate 16 to define therebetween a discharge chamber 15 which is in communication with the outlet opening 12. The bottom portion of the discharge chamber 15 serves as a reservoir for a lubricating oil, such as a refrigerator oil. The lubricating oil is supplied to the rotary component and/or thrusting component of the compressor in per se well known manner so as to establish lubrication.

Upon shipping the individual assembly, a sealing plug 10 is sealingly engaged with the inlet opening 3. On the other hand, a sealing plug 13 is sealing engaged to the outlet opening 12. Before sealing the inlet opening 3 and the outlet opening 12, inert gas is filled in the internal space of the compressor. The inert gas is supplied through the inlet opening 3 or the outlet opening 12 with a predetermined pressure. The pressurized inert gas passes the fluid path including paths 17*a* and 17*b* defined in the compressor and through a gap 6*a* between the front end face of the cam ring 8 and the front plate 6 and a gap 16*a* between the rear end face of the cam ring 8 and the rear plate 16. By this means, the inert gas is filed in the induction chamber 7, the pressure chamber 9 and the discharge chamber 15.

Figure 2:
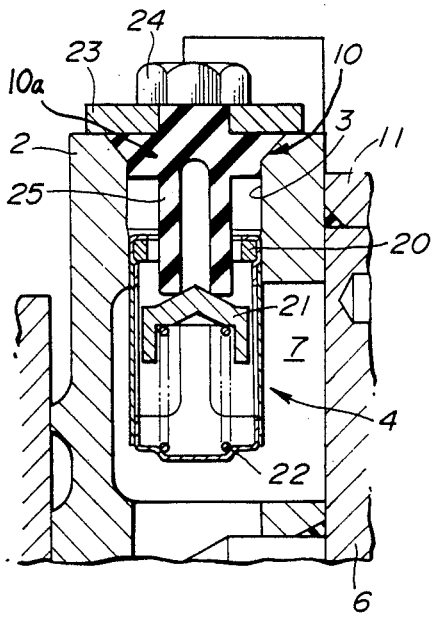
FIG. 2 is an enlarged section of an encircled section A of FIG. 1, in which the preferred embodiment the sealing plug is in a sealing position.
Figure 3:
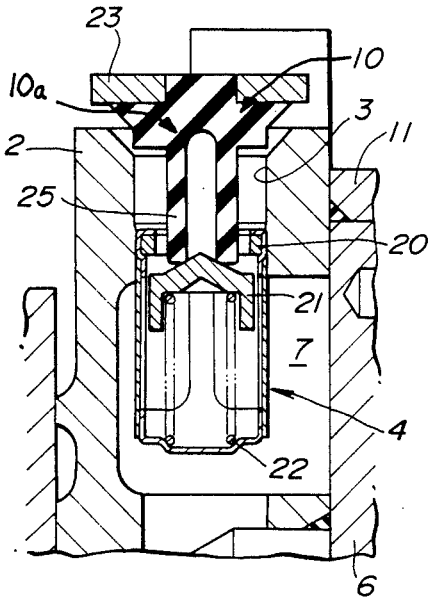
FIG. 3 is an enlarged section similar to FIG. 2 but showing the sealing plug being placed at a gas pressure discharge position.

As shown in FIGS. 1 through 3, the check valve 4 has a valve body 21 cooperative with a valve seat 20 to establish fluid tight seal. The valve body 21 is associated with a valve spring 22 so as to be normally biased toward the valve seat 20. While the compressor is in operation to rotatingly drive the rotor 5, the pressure in the induction chamber 7 becomes vacuum level to draw the valve body 21 away from the valve seat 20 against the spring force of the valve spring 22. Therefore, the check valve 4 is held open to permit the fluid to flow therethrough.

The sealing plug 10 is designed to be engaged with the inlet opening 3 as shown in the drawings and fixed at the engaged position by means of a retainer 23 and a fastener bolt 24. The sealing plug 10 has a plug body 10*a* and a cylindrical stem section 25 integrally formed with the plug body and extending therefrom. The sealing plug 10 is made of an elastically deformable material, such as a rubber. The plug body 10*a* has a circumference conforming the opening end of the inlet opening 3 so as to be tightly fitted onto the inner periphery of the opening end for establishing the fluid tight seal. On the other hand, the length of the cylindrical stem section 25 is selected so that the tip end of the stem section contacts the valve body 21 to shift the valve body way from the valve seat 20, as shown in FIG. 2. This position will be hereafter referred to as "sealing position". The length of the stem section 25 is further selected as to maintain the valve body 21 at a position away from the valve seat 20 so that the valve body 21 can be maintained at a position away from the valve seat 20 even when the valve body is shifted away from the mating periphery of the opening end of the inlet opening 3, as shown in FIG. 3. The position of the sealing plug of FIG. 3 will be hereafter referred to as "gas pressure discharge position".

Similarly, the sealing plug 13 is made of an elastically deformable material and has a configuration conforming the opening end of the outlet opening 12. The sealing plug 13 is rigidly and sealingly secured in the opening end of the outlet opening 12 by means of a retainer 26 and a fastening bolt 27.

The retainers 23 and 26 can be formed of a metal. However, it may be beneficial to form the retainers 23 and 26 by a synthetic resin for reducing the weight. This may be advantageous because of reduction of the shipping weight.

Before removing sealing plugs 10 and 13, the fastening bolt 24 is released or disengaged. By this means, the sealing plug 10 can be shifted from the sealing position of FIG. 2 to the gas pressure discharging position as shown in FIG. 3. Therefore, the internal space of the compressor is exposed to the atmosphere to permit the pressurized inert gas to flow out. By this means, the internal pressure of the compressor becomes approximately at the atmospheric pressure. After lowering the pressure, the sealing plugs 10 and 13 are removed from the inlet and outlet openings 3 and 12 for connection with the external fluid circuit.

Therefore, by utilizing the sealing plug 10, gas pressure in the compressor can be effectively lowered before removing the plug and without causing discharge of the lubricant.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

What is claimed is:

1. In a structure for enclosing a liquid state fluid and a pressurized gaseous state fluid, said structure having an opening exposed to outside of said structure for external connection, a check valve provided in the vicinity of said opening to permit fluid flow from the outside of the structure to the inside of the structure and to block fluid flow in the opposite direction, and a chamber receiving said liquid state fluid therein, which chamber is blocked from direct communication with said opening, a sealing structure comprising:

a sealing plug pluged into said opening for establishing a fluid tight seal, said sealing plug having means associated with said check valve for operating said check valve at an open position for permitting fluid flow from the inside of the structure to the outside of the structure, said sealing plug being movable between a first sealing position for establishing a gas tight seal and a second gas discharging position to permit said pressurized gaseous fluid to flow from the inside to outside.

2. A sealing structure as set forth in claim 1, wherein said plug is made of elastic material.

3. A sealing structure as set forth in claim 1, wherein said check valve comprises a valve body associated with a valve seat for establishing a fluid tight seal when it is seated on said valve seat and for permitting fluid flow when it is placed away from said valve seat, wherein said check valve operating means comprises a projection projecting from the main body of said plug to depress said valve body to maintain the latter away from said valve seat.

4. In a structure for enclosing a liquid state fluid and a pressurized gaseous state fluid, said structure having first and second openings exposed to the outside of said structure for external connection, a check valve provided in the vicinity of said first opening to permit fluid flow from the outside of the structure to the inside of the structure and to block fluid flow in the opposite direction, and a chamber receiving said liquid state fluid therein, which chamber is oriented in direct communication with said second opening and blocked direct communication with said first opening, a sealing structure comprising:

a first sealing plug pluged into said first opening for establishing fluid tight seal, said first plug having means associated with said check valve for operating said check valve at an open position for permitting fluid flow from the inside of the structure to the outside of the structure, said first plug being movable between a first sealing position for establishing gas tight seal and a second gas discharging position to permit said pressurized gaseous fluid to flow from the inside to outside; and a second sealing plug sealingly pluged into said second opening for establishing fluid tight seal.

5. A sealing structure as set forth in claim 4, wherein said first and second sealing plugs are made of elastic material.

6. A sealing structure as set forth in claim 4, wherein said check valve comprises a valve body associated with a valve seat for establishing fluid tight seal when it is seated on said valve seat and for permitting fluid flow when it is placed away from said valve seat, wherein said check valve operating means comprises a projection projecting from the main body of said plug to depress said valve body to maintain the latter away from said valve seat.

7. In a compressor having an enclosed space filled with a lubricant for lubricating components housed within said space, and a pressurized gas, said compressor defining an inlet opening and an outlet opening for connection with an external fluid circuit, and a chamber in direct communication with said outlet opening, said chamber receiving said lubricant, a sealing structure temporarily sealing said inlet opening and outlet opening, comprising:

a first sealing plug pluged into said inlet opening for establishing fluid tight seal, said first plug having means associated with said check valve for operating said check valve at an open position for permitting fluid flow from the inside of the structure to the outside of the structure, said first plug being movable between a first sealing position for establishing gas tight seal and a second gas discharging position to permit said pressurized gaseous fluid to flow from the inside to outside; and a second sealing plug sealingly pluged into said outlet opening for establishing fluid tight seal.

8. A sealing structure as set forth in claim 7, wherein said first and second sealing plugs are made of elastic material.

9. A sealing structure as set forth in claim 7, wherein said check valve comprises a valve body associated with a valve seat for establishing a fluid tight seal when it is seated on said valve seat and for permitting fluid flow when it is placed away from said valve seat, wherein said check valve operating means comprises a projection projecting from the main body of said plug to depress said valve body to maintain the latter away from said valve seat.

* * * * *